United States Patent [19]

Potter

[11] 4,055,387

[45] Oct. 25, 1977

[54] LIQUID FUEL INJECTION PUMPING APPARATUS

[75] Inventor: James Charles Potter, London, England

[73] Assignee: CAV Limited, Birmingham, England

[21] Appl. No.: 638,156

[22] Filed: Dec. 5, 1975

[30] Foreign Application Priority Data

Dec. 6, 1974 United Kingdom ..... 52969/74

[51] Int. Cl.[2] ..... F04B 1/06; F04B 19/02

[52] U.S. Cl. ..... 417/221; 123/139 ST; 123/179 L; 417/462

[58] Field of Search ..... 92/13.4, 13.6, 60.5; 123/179 G, 179 L, 139 ST, 139 AE; 417/221, 462

[56] References Cited

U.S. PATENT DOCUMENTS

| | | | |
|---|---|---|---|
| 1,081,817 | 12/1913 | Deming | 92/13.4 |
| 2,775,233 | 12/1956 | Bischoff et al. | 123/139 ST |
| 2,828,697 | 4/1958 | Roosa | 417/462 X |
| 3,000,318 | 9/1961 | Volossevich | 417/214 X |
| 3,046,905 | 7/1962 | Davis | 417/462 X |
| 3,338,168 | 8/1967 | Davis | 417/214 X |
| 3,650,259 | 3/1972 | Garnier | 417/462 X |
| 3,847,509 | 11/1974 | Bonin | 417/462 X |
| 3,883,270 | 5/1975 | Baxter | 417/221 |
| 3,895,886 | 7/1955 | Leblanc | 417/462 |

FOREIGN PATENT DOCUMENTS

| | | | |
|---|---|---|---|
| 1,451,968 | 9/1969 | Germany | 123/179 L |

*Primary Examiner*—Irwin C. Cohen

[57] ABSTRACT

A fuel pumping apparatus includes an annular cam having cam lobes which urge a pumping plunger in an inward direction through a roller during an injection stroke. A feed pump supplies fuel by way of a throttle to a bore containing the plunger during a filling stroke and a pair of ring members limit the outward movement of the roller and thereby control the maximum fuel. The ring members can be moved axially away from each other to allow an extra amount of fuel to be supplied for starting purposes.

5 Claims, 7 Drawing Figures

FIG.4.
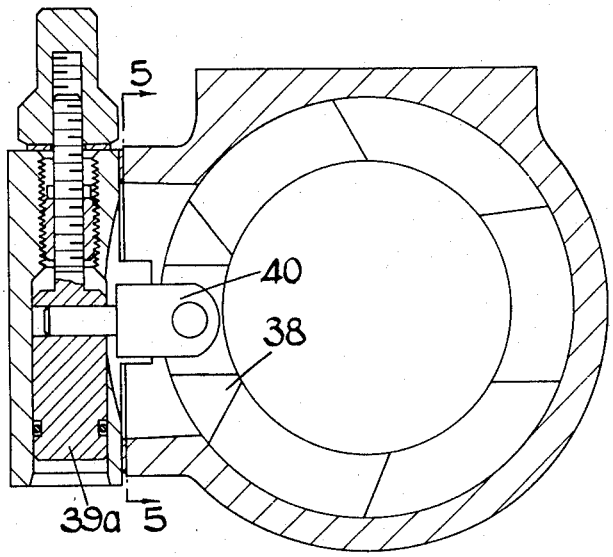
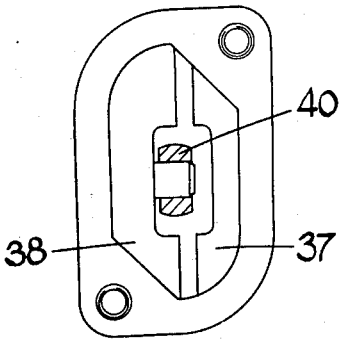
FIG.5.

LIQUID FUEL INJECTION PUMPING APPARATUS

This invention relates to liquid fuel injection pumping apparatus for supplying fuel to internal combustion engines and of the kind comprising combination, an injection pump adapted to be driven in timed relationship with an engine with which the apparatus is associated, said injection pump including a plunger movable within a bore defined in a rotary part of the injection pump, an annular cam ring surrounding said part, said cam ring having angularly spaced cam lobes arranged to effect through a roller, movement of the plunger as said part rotates, an outlet connected to said bore and through which fuel flows during movement of the plunger by the cam lobes, the apparatus also including means for supplying fuel to said bore to effect movement of the plunger in the opposite direction to that effected by said cam lobes, said means including a control device for determining the amount of fuel supplied by the injection pump.

The object of the invention is to provide such an apparatus in a simple and convenient form.

According to the invention, a liquid fuel injection pumping apparatus of the kind specified comprises stop means for limiting the movement of the plunger in the outward direction thereby to control the maxiumum amount of fuel which can be supplied by the injection pump irrespective of the setting of said control device, said stop means being temporarily adjustable to allow additional outward movement of the plunger so that the injection pump can supply an additional amount of fuel for starting the engine.

According to a further feature of the invention, said stop means co-operates with the ends of the roller to limit the movement of the plunger.

According to a further feature of the invention, said stop means comprises a pair of members disposed at the ends of the roller respectively, said members and said roller being shaped so that movement of said members away from each other in an axial direction relative to the axis of the roller will permit said roller and the plunger to move outwardly.

According to a further feature of the invention, said members are of annular form.

Two examples of a liquid fuel pumping apparatus in accordance with the invention will now be described with reference to the accompanying drawings in which:

FIG. 4 is a view on the line 4—4 of FIG. 2 with parts removed for the sake of clarity.

FIG. 5 is a section on the line 5—5 of FIG. 4, with parts removed for the sake of clarity.

Figure 1:
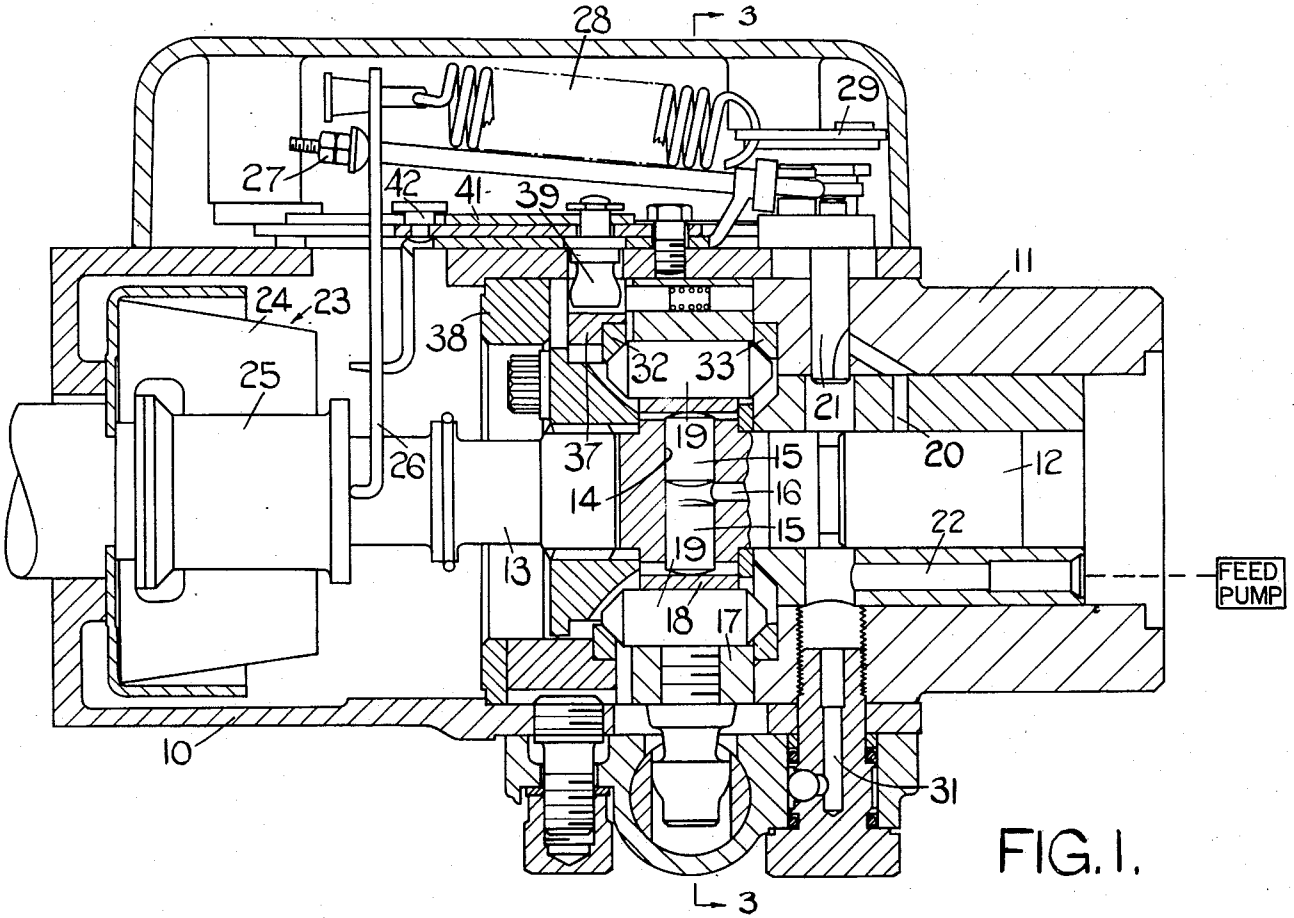
FIG. 1 is a sectional side elevation of one example of the apparatus.
Figure 2:
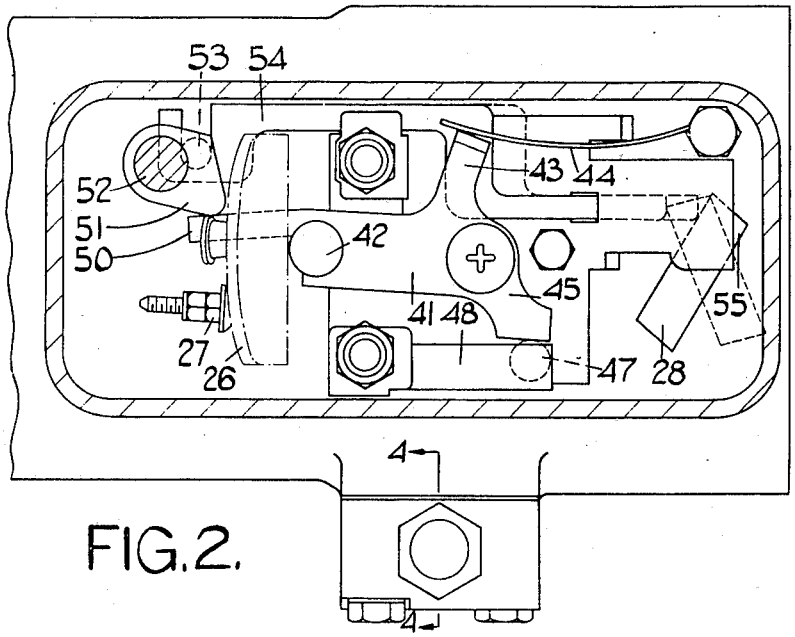
FIG. 2 is a plan view of the apparatus seen in FIG. 1.

Referring to FIGS. 1-7 of the drawings, there is provided a casing 10 which is of open ended form, and the open end of which mounts a housing 11. Mounted within the housing 11 is a rotary cylindrical distributor member 12 which is coupled to a drive shaft 13 adapted to be driven in timed relationship with the associated engine. Located within the distributor member 12 is a transversely extending bore 14 in which is mounted a pair of reciprocable pumping plungers 15. The plungers 15 communicate in known manner, with a longitudinally extending bore 16 formed in the distributor member, and this at one point, communicates with a radially extending delivery passage (not shown) which is adapted to register in turn and as the distributor member rotates, with outlet ports not shown, formed in the housing 11. The outlet ports in use, are connected to the injection nozzles of the associated engine.

The plungers are moved inwardly at the appropriate angular position of the distributor member, by means of cam lobes which are formed on the internal periphery of an annular cam ring 17 which is mounted within the housing 10. For this purpose, each roller bears against a shoe 18 which mounts a roller 19.

In order to move the plungers 15 outwardly, fuel under pressure is supplied to the bore 14, and conveniently this fuel flows through an inlet port 20 which is formed in the housing 11 and which communicates with a source of fuel under pressure by way of a throttle valve 21. The source of fuel conveniently is a feed pump which is located within a recess in the housing, the feed pump having its rotary part carried by an extension of the distributor member 12. Moreover, the outlet of the feed pump is connected to a supply passage 22. defined in the housing. The amount of fuel which is supplied to the bore 14 is determined by the setting of the throttle member 21 and the position of the throttle member is determined by a governor mechanism which includes a weight mechanism 23 incorporating weights 24 which can move outwardly and thereby effect movement of a sleeve 25 mounted above the drive shaft 13. The movement of the sleeve 25 is imparted to one end of a lever 26, the other end of the lever being connected by means of a link 27 to an arm 28 carried by the throttle member 21. A governor spring 28 is also provided and one end of the spring is secured to the end of the lever 26 whilst the other end of the spring is secured to an arm 29 mounted on an operator adjustable shaft not shown. In operation, for a given setting of the arm 29, the weights will move outwardly as the speed of the engine increases, and in so doing will effect angular movement of the throttle member to reduce the amount of fuel supplied to the engine. Conversely, if the engine speed should drop due to an increased load on the engine, then the throttle member will be moved to increase the amount of fuel supplied to the engine.

Figure 3:
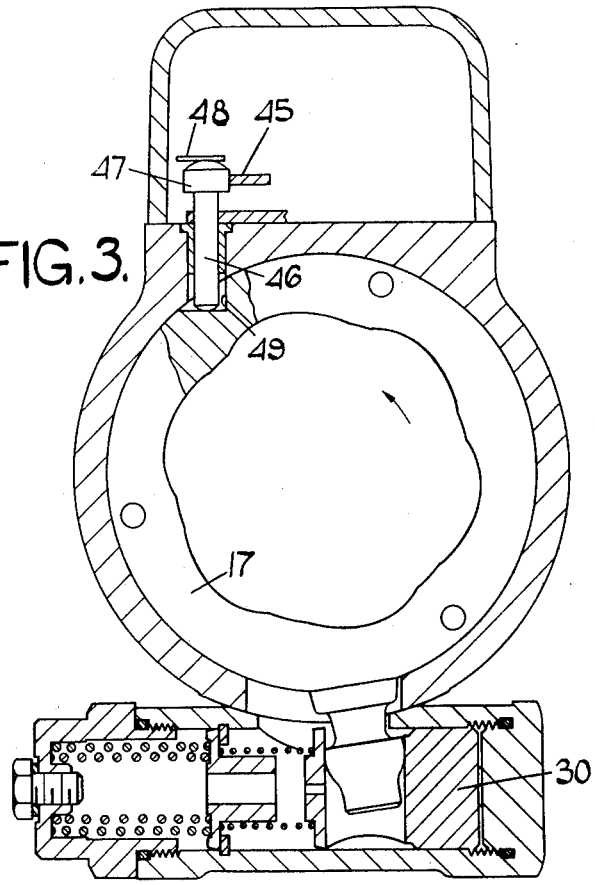
FIG. 3 is a section of the line 3—3 of FIG. 1 with parts removed for the sake of clarity.

The angular position of the cam ring 17 is adjustable in known manner, by means of a fluid pressure operable piston 30 which is seen in side elevation in FIG. 3. The piston is provided with a recess in which is located a peg secured to the cam ring 17. The piston 30 is subjected to the outlet pressure of the feed pump, and conveniently this flows from the supply passage 22 by way of a further passage 31. The outlet pressure of the feed pump is controlled in known manner, by means of a valve not shown, so that the pressure varies in accordance with the speed at which the apparatus is driven.

The piston 30 is spring loaded, and in the absence of fuel pressure as occurs when the engine is at rest, the cam ring 17 is moved in the direction so that the timing of injection of fuel to the engine is fully retarded. This is the position in which the cam ring is shown in FIG. 3. As the engine speed increases, the cam ring 17 will move in the clockwise direction as seen in FIG. 3, and the timing of injection of fuel to the engine will be advanced.

In all forms of fuel injection pumping apparatus, it is necessary to provide a stop to limit the normal maximum amount of fuel which may be supplied by the pumping apparatus, irrespective of the setting of the control means. This is to ensure the minimum emission of smoke from the exhaust of the associated engine.

Figure 6:
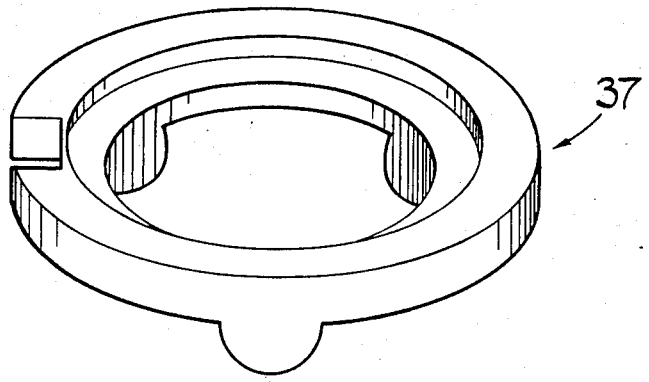
FIGS. 6 and 7 are perspective views of parts of the apparatus.
Figure 7:
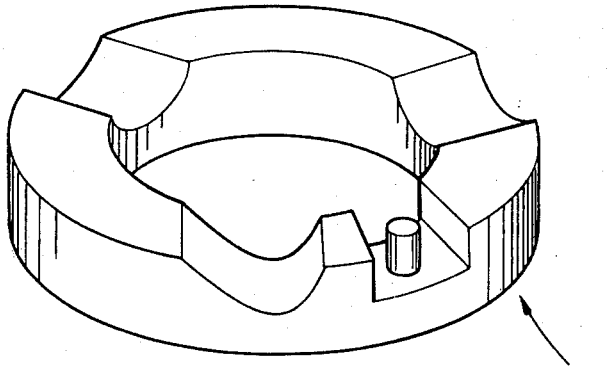

Referring to FIG. 1, the maximum amount of fuel which can be supplied to the engine is limited by limiting the outward movement of the rollers 19, and for this purpose the end portions of the rollers 19 co-operate with a pair of annular members of stop rings 32, 33 respectively. For this purpose the end portions of the rollers 19 are of tapering form and the surfaces of the members 32 and 33 are of complementary shape. The member 33 is located against a step defined in the housing 11, but the member 32 is carried upon an annular ring member 37 which is both angularly and axially adjustable within the casing 10. A further ring member 38 is provided, and this is located within the casing 10. Furthermore, the abutting end faces of the ring members 37 and 38 are provided as seen in FIGS. 6 and 7 with complementary cam profiles so that if the ring member 37 is moved angularly it will also move axially.

As shown in FIG. 1, the ring member 37 is engaged by a peg 39 located within an axial slot formed in the ring member 37. The peg can be moved between extreme positions as will be described. In one such extreme position, the normal maximum amount of fuel will be supplied to the engine, but as the peg is moved to the other extreme position, the ring members 37 and 38 will move towards each other thereby effecting separation of the annular members 32 and 33 and thereby allowing the rollers 19 to move outwardly an additional extent. This position is shown in the drawings, and the pumping apparatus will supply an excess of fuel for starting purposes. In said one extreme position of the peg 39, the ring members 37, 38 will be separated their maximum extent and thereby the permitted outward movement of the rollers 19 will be reduced. In order to adjust the normal maximum amount of fuel which may be supplied to the engine, the ring member 38 is angularly movable within the casing 10 a limited extent. The angular position of the ring member 38 is determined by an adjustable stop member **39*a* which is coupled to the ring member 38 by means of a link 40**.

As has been stated it is necessary to move the peg 39 in order to obtain an excess of fuel for starting purposes. The peg 39 depends from a pivotal plate 41 which is carried on the exterior of the casing 10. The plate is pivotable about a pivot pin 42 the position of which is seen in FIG. 1, the plate 41 in fact having a slot the walls of which locate against the pin. The peg 39 is closely confined within a circumferentially extending slot in the casing 10. The plate 41 has one arm 43 which is engaged by a leaf spring 44 in order to urge the plate 41 in a direction so that the normal maximum amount of fuel is supplied by the apparatus. The plate 41 includes a second arm 45 which is engageable with a pin 46 having a head 47 which is engaged by a leaf spring 48. The pin 46 extends through a bore in the casing 10 into engagement with the periphery of the annular cam ring 17. At one point in the periphery of the cam ring there is formed a recess 49 into which the pin 46 can drop when the cam ring 17 is moved to the position of maximum retard as occurs when the apparatus is at rest. When the engine is started, and the speed thereof increases, the cam ring 17 is moved angularly and the pin 46 will be urged outwardly against the action of the spring 48 until it is completely clear of the recess 49 and is running on the periphery of the cam ring 17. As shown in FIG. 3, the arm 45 is engaging with the head 47 of the pin 46, and in this position the peg 39 is moved to a position in which an excess of fuel is supplied for starting purposes. As the engine starts and as the cam ring moves angularly, a point will be reached at which the arm 45 of the lever 41 is released by the head 47 of the pin and is urged by the spring 44 into contact with the shank of the pin. When this occurs, the plate 41 moves angularly and the peg 39 is moved to a position so that the normal maximum amount of fuel is supplied to the apparatus.

If the associated engine is now stopped, the pin 46 is prevented from movement into the recess 49 as the cam ring 17 moves to the fully retard position. This is because the arm 45 of the plate 41 engages beneath the head 47 of the pin. It will be seen therefore that the apparatus does not automatically provide excess fuel when the associated engine has been stopped, and is then restarted.

In order to obtain excess fuel for starting purposes and retain excess fuel after the engine has started, it is necessary to move the plate 41 angularly about the pivot pin 42 and against the action of the spring 44. Such angular movement will move the peg 39 so as to permit further outward movement of the rollers, and at the same time the arm 45 will be moved from beneath the head 47 so that the parts can assume the position shown in FIG. 3. For the purpose of moving the plate 41, the latter is provided with an extension 50 extending on the other side of the pin 42. For engagement with the extension 50, there is provided a cam form 51 which is carried on an angularly adjustable shaft 52. The shaft 52 is connected to a driver operable shut-off lever, and the cam form 50 is formed on a plate which also carries a pin 53, this being shown in dotted outline in FIG. 2. The pin 53 is engageable within a slot defined in a movable shut-off plate 54 having an extension positioned to engage with an extension 55 of the arm 28 carried by the throttle member. When the shaft 52 is moved angularly, the pin 53 effects axial movement of the plate 54, and this in turn moves the throttle control to a position to cut off the supply of fuel to the engine. During this movement there is no contact between the cam form 51 and the extension 50 of the plate 41. Upon further movement of the shut-off lever, however, the cam form 51 engages the extension 50 and the plate 41 is pivoted about the pin 42 towards a position in which an excess of fuel is obtained for starting purposes. The pin 46 can then assume the position in which it is shown in FIG. 3 in which position the arm 45 of the plate 41 engages the head 47 of the pin so that the excess fuel selection is maintained. As soon as the plate 41 has been pivoted, the operator adjustable member is returned to its initial position which thereby allows the throttle member to assume a position so that fuel will be supplied to the engine. Usually, the operator will set the throttle control, i.e. the accelerator pedal, to a position such that the throttle member 21 is fully open and in this manner, the plungers will be moved outwardly their maximum extent so that excess fuel will be supplied. As previously stated, as soon as the engine starts and the cam 17 starts to move angularly, a position will be reached by the pin 46 at which the arm 45 is urged beneath the head 47 of the pin and the supply of excess fuel ceases. The supply of excess fuel does therefor continue for a short time after the engine has started.

By the apparatus described, it will be seen that the apparatus only supplies excess fuel when it is called upon to do so and in order to obtain excess fuel, the engine must be at rest, and the stop control of the apparatus must be actuated. Furthermore, if the stop control of the apparatus is actuated whilst the engine is running, then two things prevent the supply of excess fuel. Firstly, the plate 41 is unable to move to the excess fuel position because the pin 46 will have been moved by the cam, and secondly selection of excess fuel by the operator will in fact cut off the supply of fuel to the engine by virtue of the normal stop control.

I claim:

1. A liquid fuel injection pumping apparatus for supplying fuel to an internal combustion engine and comprising a housing, an injection pump located within the housing and adapted to be driven in timed relationship with an engine with which the apparatus is associated, said injection pump including a rotary part supported within the housing, a bore defined in said rotary part, a plunger movable in said bore, an angularly adjustable cam ring surrounding said part and having angularly spaced cam lobes, a roller engaging said cam ring and positioned between the cam ring and the plunger, an outlet connected to said bore and through which fuel flows during movement of the plunger by the cam lobes, a fuel feed pump for supplying fuel to said bore to effect outward movement of the plunger in the direction opposite to that effected by the cam lobes, said fuel feed pump being driven by said rotary part, a control device for determining the amount of fuel supplied to the injection pump from said fuel feed pump, a pair of stop rings positioned at the opposite ends of the roller for limiting the outward movement of the plunger thereby to control the maximum amount of fuel which can be supplied by the injection irrespective of the setting of said control device, the spacing of said stop rings being temporarily adjustable to allow additional outward movement of the plunger so that the injection pump can supply an additional amount of fuel for starting purposes, a first ring member mounting one of said stop rings, said first ring member being axially and angularly movable within the housing, a second ring member positioned in side by side relationship to said first ring member, means locating said second ring member against axial movement in the direction away from the other stop ring, adjustment means for providing limited angular adjustment of said second ring member, interengageable formations on the adjacent side faces of said ring members whereby relative angular movement of said ring members will result in relative axial movement thereof, a piston cylinder combination mounted on said housing, means connecting said piston to said cam ring whereby movement of the piston within the cylinder will impart angular movement to the cam ring to adjust the timing of delivery of the injection pump, passage means connecting said cylinder with the outlet of the feed pump, a peg engaged with said first member, a slot for guiding the movement of the peg between extreme positions, the peg during movement from one extreme position to the other imparting angular movement to said first ring member, the spacing of the stop rings in said one extreme position being such that the normal maximum amount of fuel can be delivered as determined by the setting of said adjustment means, and in said other extreme position the spacing of the stop rings being such that excess of fuel can be delivered, resilient means acting to bias said peg towards said one extreme position, catch means for retaining said peg in said other extreme position, said catch means including a pin member engaging said cam ring and operable by said cam ring whereby when said cam ring is moved angularly by said piston said catch means is released to allow the peg to assume said one extreme position.

2. An apparatus according to claim 1 in which said pin member is engageable with the periphery of the cam ring, a recess defined in the periphery of said cam ring into which said pin member can move, resilient means biasing said pin member into said recess, said pin member entering said recess when the fuel pressure is zero, said pin member when located in said recess maintaining said peg in said other extreme position, said pin member being urged out of said recess during increase of said fuel pressure to allow said peg to move to said one extreme position.

3. An apparatus according to claim 2 including a head formed on said pin member, a pivotal plate mounted on the housing, said plate mounting said peg, a first arm on said plate for engagement with the head of said pin member to position the peg in said other extreme position, and with the shank of the pin to position the peg in said one extreme position.

4. Apparatus according to claim 3 including a second arm on said plate, and manually operable means engageable with said second arm, said manually operable means being actuable to pivot the plate to move said first arm away from said pin thereby to enable the pin member to move into said recess when the output pressure of the fuel pump is zero.

5. An apparatus according to claim 4 including a movable shut-off plate, means on said manually operable means for effecting movement of said shut-off plate, said control device including a member engageable by said shut-off plate whereby movement of the manually operable means will effect movement of said member to shut off the supply of fuel to the injection pump.

* * * * *